US009044134B2

(12) United States Patent
Park et al.

(10) Patent No.: US 9,044,134 B2
(45) Date of Patent: Jun. 2, 2015

(54) DISHWASHER

(71) Applicant: LG Electronics Inc., Seoul (KR)

(72) Inventors: Younghwan Park, Seoul (KR); Minhan Kim, Seoul (KR); Sangheon Yoon, Seoul (KR); Kiyoung Kang, Seoul (KR)

(73) Assignee: LG Electronics Inc., Seoul (KR)

( * ) Notice: Subject to any disclaimer, the term of this patent is extended or adjusted under 35 U.S.C. 154(b) by 283 days.

(21) Appl. No.: 13/628,233

(22) Filed: Sep. 27, 2012

(65) Prior Publication Data

US 2013/0139859 A1 Jun. 6, 2013

(30) Foreign Application Priority Data

Sep. 27, 2011 (KR) ..... 10-2011-0097732

(51) Int. Cl.

| | |
|---|---|
| ***A47L 15/00*** | (2006.01) |
| ***A47L 15/42*** | (2006.01) |
| ***A47L 15/16*** | (2006.01) |
| *A47L 15/23* | (2006.01) |

(52) U.S. Cl.

CPC ..... *A47L 15/428* (2013.01); *A47L 15/16* (2013.01); *A47L 15/23* (2013.01); *A47L 15/4282* (2013.01)

(58) Field of Classification Search

None

See application file for complete search history.

(56) References Cited

U.S. PATENT DOCUMENTS

| | | | | |
|---|---|---|---|---|
| 5,131,419 | A | 7/1992 | Roberts | |
| 7,032,604 | B2 * | 4/2006 | Welch | 134/135 |
| 2010/0101611 | A1 * | 4/2010 | Chen et al. | 134/25.2 |
| 2011/0214702 | A1 | 9/2011 | Brown-West et al. | |

FOREIGN PATENT DOCUMENTS

| | | |
|---|---|---|
| DE | 195 44 985 A1 | 6/1996 |
| EP | 0147018 | 7/1985 |
| JP | H09-164105 | 6/1997 |
| JP | H11-076127 | 3/1999 |
| JP | H11-099117 | 4/1999 |
| JP | 2005-228048 | 10/2005 |
| JP | 2008-229224 | 10/2008 |
| KR | 10-2004-0006218 | 1/2004 |
| KR | 10-2007-0056280 | 6/2007 |

OTHER PUBLICATIONS

German Office Action issued Jun. 11, 2013 from German Patent Application No. 10 2012 217 566.0, including English translation, 6 pages.

Korean Office Action dated Mar. 8, 2013 from Korean Patent Application No. 10-2011-0097732, 5 pages.

International Search Report dated Mar. 13, 2013 from International Patent Application No. PCT/KR2012/007766, 3 pages.

* cited by examiner

*Primary Examiner* — Jason Ko

(74) *Attorney, Agent, or Firm* — Fish & Richardson P.C.

(57) ABSTRACT

A capable of efficiently disposing nozzles spraying washing water is provided. A dishwasher includes a washing tub, an upper rack, a lower rack and a middle nozzle. The washing tub forms a space in which dishes are washed. The upper rack has the dishes loaded thereto, being provided inside the washing tub. The lower rack is provided below the upper rack, being provided inside the washing tub. The middle nozzle sprays washing water toward the upper and lower racks, being provided on side walls of the washing tub.

10 Claims, 6 Drawing Sheets

DISHWASHER

BACKGROUND OF THE INVENTION

1. Field of the Invention

The present invention relates to a dishwasher. More specifically, the present invention relates to a dishwasher capable of efficiently disposing nozzles spraying washing water.

2. Description of the Conventional Art

In general, a dishwasher is an electric home appliance that washes food wastes adhering to surfaces of dishes by spraying high pressure washing water to the dishes through spray nozzles.

The dishwasher includes a washing tub and a sump in which washing water is stored, being disposed in a lower part of the washing tub. The washing water is moved to a spray module by the pumping operation of a washing pump disposed inside the sump, and the washing water moved to the spray module is sprayed with high pressure through spray nozzles formed at end parts of the spray module. Then, the washing water collides with surfaces of dishes, and contaminants such as food wastes adhering to the dishes fall on the bottom of the washing tub.

The dishwasher is provided with racks to which dishes are loaded. In a case where the spray nozzles are provided between the racks, the size of dishes loaded to the rack may be limited.

SUMMARY OF THE INVENTION

The invention has been made in an effort to provide a dishwasher capable of efficiently disposing nozzles spraying washing water.

It is to be understood that technical problems to be solved by the present invention are not limited to the aforementioned technical problems and other technical problems which are not mentioned will be apparent from the following description to the person with an ordinary skill in the art to which the present invention pertains.

A dishwasher according to the present invention includes a washing tub forming a space in which dishes are washed; an upper rack to which the dishes are loaded, being provided inside the washing tub; a lower rack provided below the upper rack, being provided inside the washing tub; and a middle nozzle spraying washing water toward the upper and lower racks, being provided on side walls of the washing tub.

Detailed items of other embodiments are included in detailed description and drawings.

DETAILED DESCRIPTION OF THE PREFERRED EMBODIMENTS

The present invention now is described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
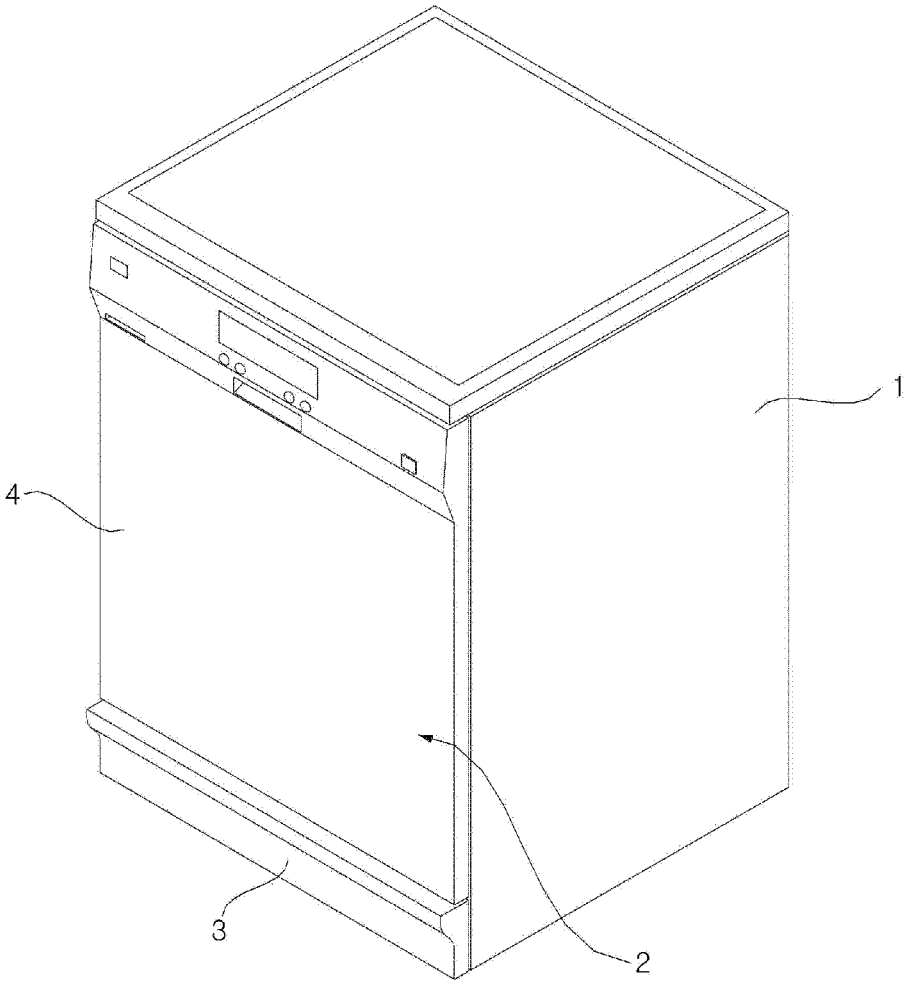
FIG. 1 is a perspective view of a dishwasher according to an embodiment of the present invention.
Figure 2:
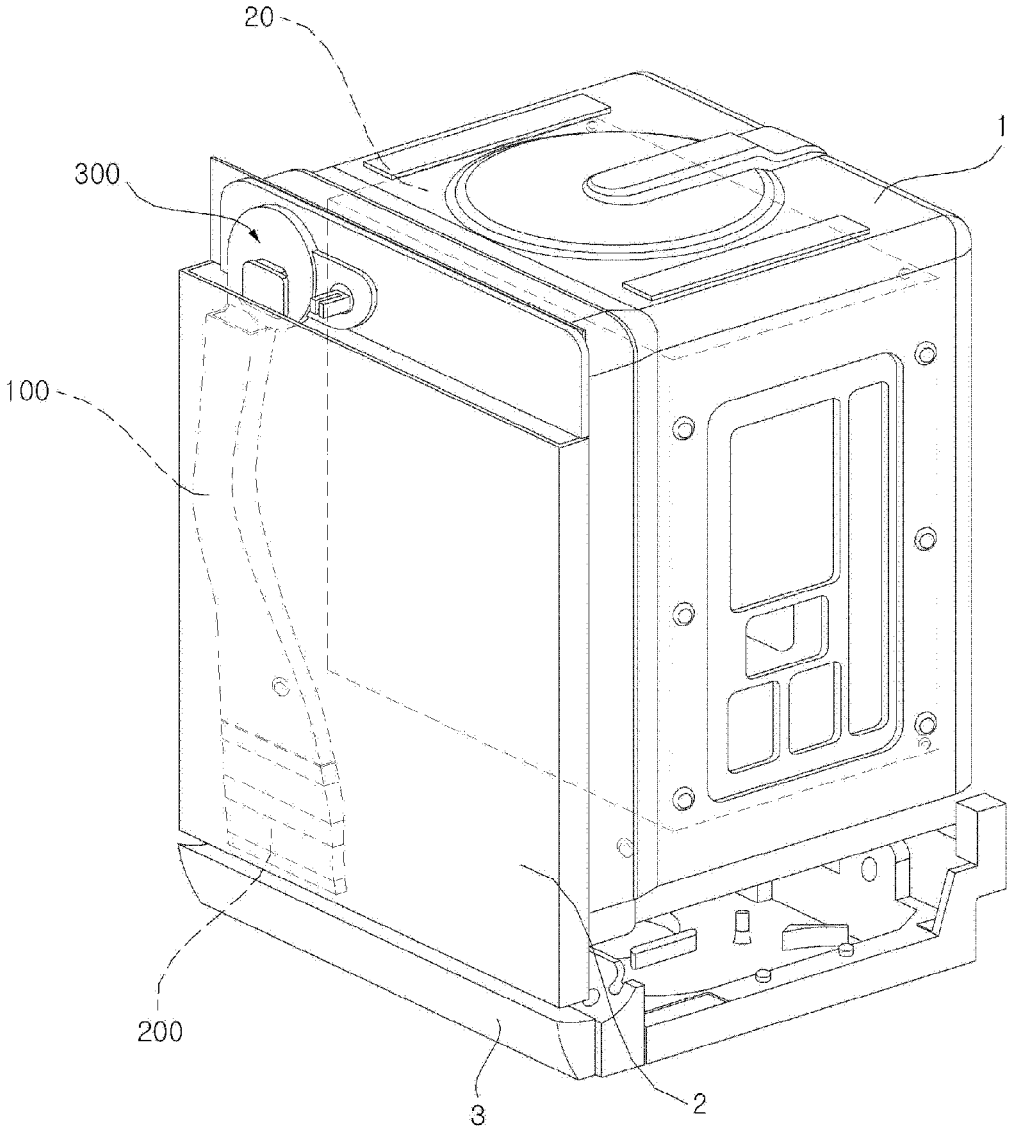
FIG. 2 is a perspective view illustrating a state in which the exterior of the dishwasher shown in FIG. 1 is removed.

FIG. 1 is a perspective view of a dishwasher according to an embodiment of the present invention. FIG. 2 is a perspective view illustrating a state in which the exterior of the dishwasher shown in FIG. 1 is removed.

Referring to FIGS. 1 and 2, the dishwasher according to the embodiment of the present invention includes a case 1 forming the exterior of the dishwasher and having a front opened, a door 2 opening/closing the opened front of the case 1, a front cover provided to the front of the door 2, and a lower cover 3 provided at a lower part of the front of the case 1.

The case 1 forms the exterior of the dishwasher and provides a frame in which parts of the dishwasher are loaded. The case 1 has the front opened, and a user loads dishes inside the case 1 through the front.

The case 1 is provided with the washing tub 20 forming the space in which the dishes are washed therein. The dishes are washed in the washing tub 20. Like the case 1, the washing tub 20 has a front opened, so that the user loads the dishes inside the washing tub 20 through the opened front of the case 1.

The door 2 opens/closes the front of the case 1, and the washing tub 20 is made airtight by the door 2 while the dishes are washed inside the washing tub 20. The door 2 is rotatably coupled to the case 1, so that the front of the case 1 can be opened/closed.

The front cover 4 is provided at the front of the door 2. The front cover 4 allows the exterior of the dishwasher to be beautiful at the front of the door 2.

The lower cover 3 is provided at the front of the case 1. The lower cover 3 allows the exterior of the dishwasher to be beautiful together with the front cover 4, being provided at the lower part of the front of the case 1.

A fan assembly 300, an exhaust duct 100 and an outlet 200 are provided inside the door 2. The fan assembly 300 sucking air inside the washing tub 20 so as to exhaust the air inside the washing tub 20 to the outside of the dishwasher, and the exhaust duct 100 exhausting the air inside the washing tub 20, sucked by the fan assembly 300, to the outside. The outlet 100 is coupled to one side of the exhaust duct 100 so as to exhaust the air sucked by the fan assembly 300 to the outside toward the front of the case 1, which is a direction in which the door 2 is opened.

Figure 3:
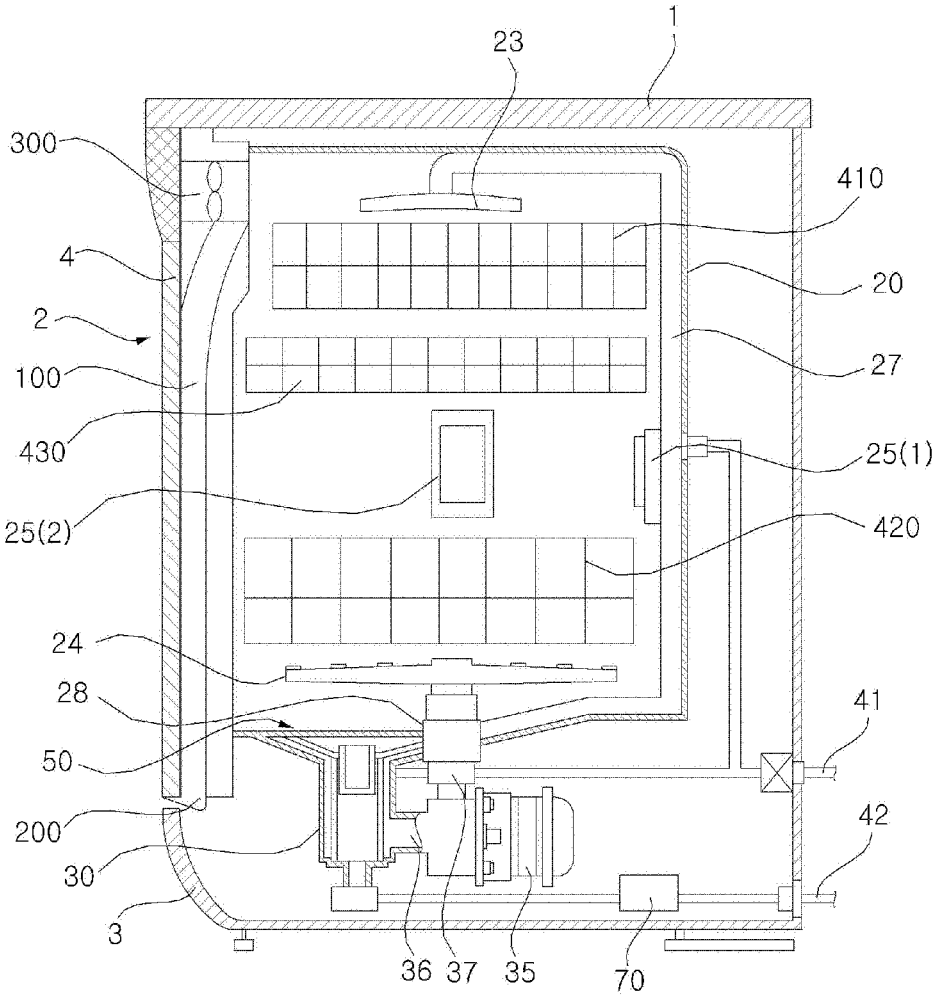
FIG. 3 is a sectional view of a dishwasher according to an embodiment of the present invention.
Figure 4:
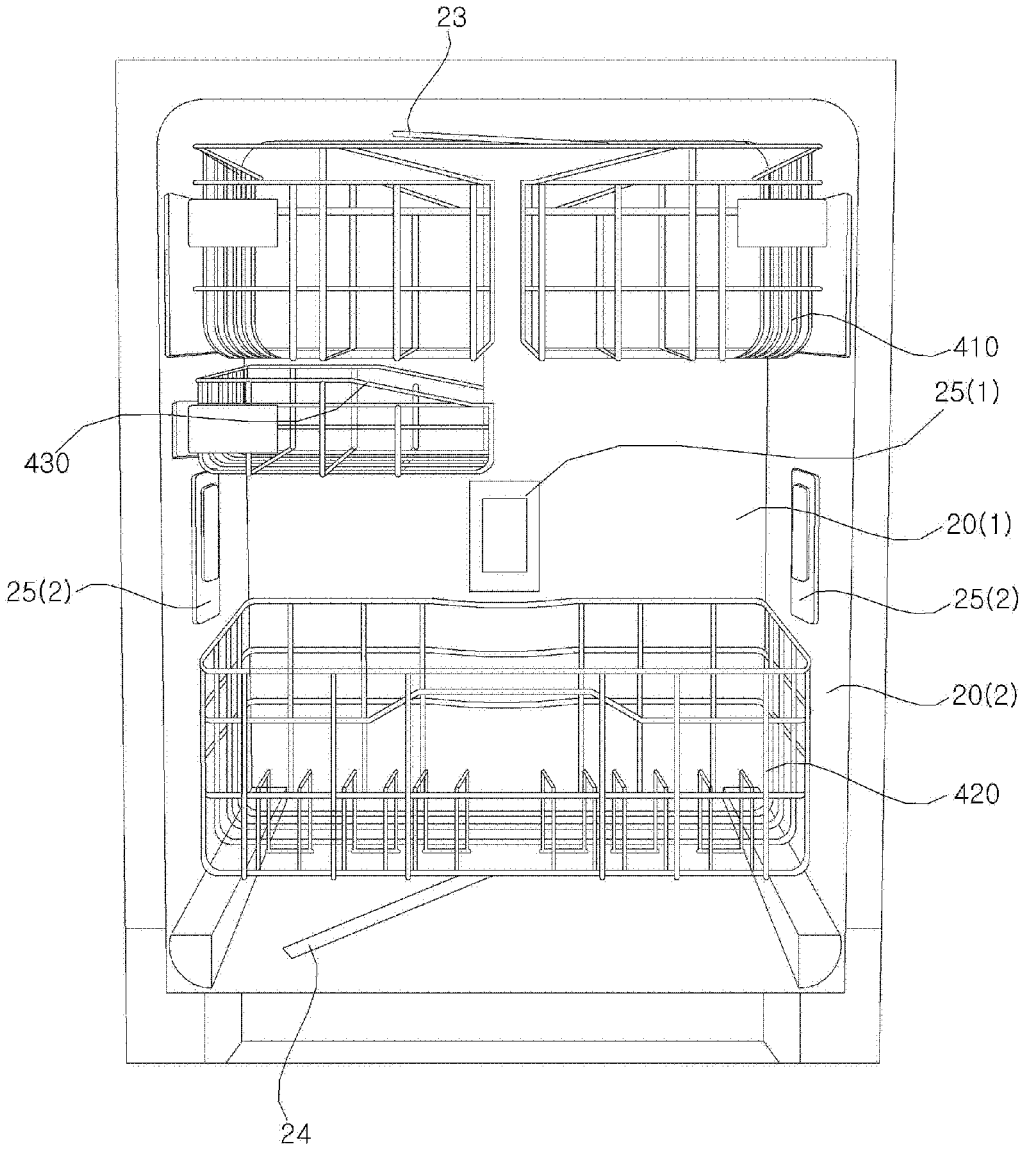
FIG. 4 is a front view of a washing tub in the dishwasher shown in FIG. 3.

FIG. 3 is a sectional view of a dishwasher according to an embodiment of the present invention. FIG. 4 is a front view of a washing tub in the dishwasher shown in FIG. 3.

The dishwasher according to the embodiment of the present invention includes a washing tub 20 forming a space in which dishes are washed, an upper rack 410 to which the dishes are loaded, being provided inside the washing tub 20, a lower rack 420 provided below the upper rack 410, being provided inside the washing tub 20, and a middle nozzle 25 spraying washing water toward the upper and lower racks 410 and 420, being provided on a side wall of the washing tub 20.

The washing tub 20 forms the space in which the dishes are washed. The front of the washing tub 20 is opened/closed by the door 2, being opened. The circumference of the washing tub 20 is formed by rear and side walls 20(1) and 20(2) except the opened front. The rear and side walls 20(1) and 20(2) of the washing tub 20 includes both side walls 20(2) that are both sides of the opened front and a rear wall 20(1) that is a rear opposite to the front.

A sump 30 collecting washing water sprayed into the washing tub 20 is provided at a lower part of the washing tub 20. A filter assembly 50 filtering foreign matters in washing water flowed into the sump 30 is mounted in the sump 30.

The upper rack 410, a middle rack 430 and the lower rack 420, to which the dishes are loaded, are provided inside the washing tub 20. The upper rack 410 is provided at an upper part of the washing tub 20, and the lower rack 420 is provided at a lower part of the washing tub 20, which is disposed below the upper rack 410. The middle rack 430 is provided between the upper and lower racks 410 and 420.

The middle rack 430 is preferably provided to be attachable/detachable to/from the washing tub 20. The middle rack 430 can be attached to the washing tub 20 by adjusting the height of the middle rack 430. In a case where the middle rack 430 is removed from the washing tub 20, a dish with high height, such as a bucket, may be loaded to the lower rack 420.

An upper nozzle 23, a lower nozzle 24 and the middle nozzle 25 are provided inside the washing tub 20. The upper nozzle 23 sprays the washing water toward the upper rack 410, and the lower nozzle 24 sprays the washing water toward the lower rack 420. The middle nozzle 25 sprays the washing water toward the upper and lower racks 410 and 420.

The upper nozzle 23 sprays the washing water toward the upper rack 410, being provided above the upper rack 410. The upper nozzle 23 is formed in a rod shape to rotate while spraying the washing water at both ends thereof.

The lower nozzle 24 sprays the washing water toward the lower rack 420, being provided below the lower rack 420. The lower nozzle 24 is formed in a rod shape to rotate while spraying the washing water at both ends thereof.

The middle nozzle 25 sprays the washing water toward the upper rack 410 and/or the lower rack 420, being provided on the rear and side walls 20(1) and 20(2) of the washing tub 20. The middle nozzle 25 is preferably disposed between the upper and lower racks 410 and 420. The middle nozzle 25 may include a plurality of both-side middle nozzles 25(2) provided on both the side walls 20(2) that are both sides of the opened front of the washing tub 20, and a rear middle nozzle 25(1) provided on the rear wall 20(1) that is a rear opposite to the front of the washing tub 20. The plurality of both-side middle nozzles 25(2) spray the washing water in the side directions, being respectively provided on both the side walls 20(2). The rear middle nozzle 25(1) sprays the washing water in the front direction, being provided on the rear wall 20(1).

An upper flow path 27 and a lower flow path 28 are provided inside the washing tub 20 so that the washing water collected into the sump 30 is supplied to the upper, middle and lower nozzles 23, 25 and 24.

The washing tub 20 is provided with a water supply flow path 41 through which water from an external water source connected to the washing tub 20 is supplied to the inside of the washing tub 20, and a drainage flow path 42 through which contaminated washing water is drained to the outside of the dishwasher.

A drainage pump 70 for draining the washing water collected into the sump 30 to the outside of the dishwasher is provided on the drainage flow path 42. The drainage flow path 42 is preferably formed of a damping member capable of absorbing vibration, such as rubber or flexible pipe.

A washing pump 35 for supplying the washing water collected into the sump 30 to the upper, middle and lower nozzles 23, 25 and 24 is provided at a lower part of the washing tub 20. A suction pipe 36 connects the sump 30 to the washing pump 35, and a discharge pipe 37 connects the washing pump 35 to the upper and lower flow paths 27 and 28.

Figure 5:
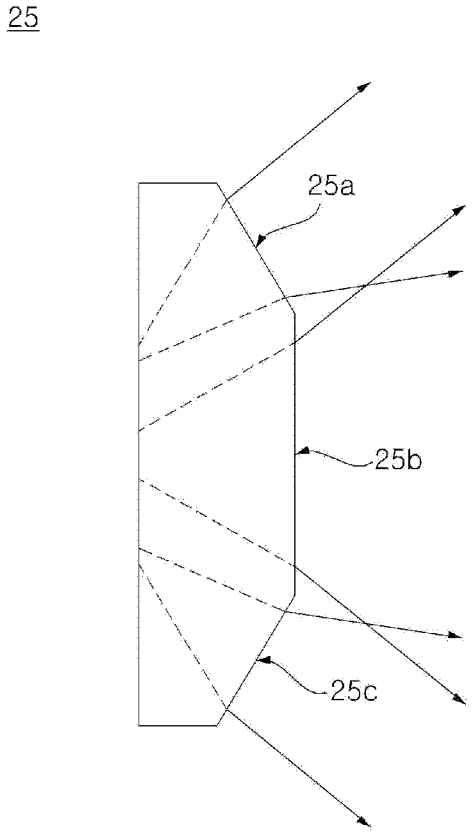
FIG. 5 is a view illustrating a middle nozzle of the dishwasher according to an embodiment of the present invention.

FIG. 5 is a view illustrating a middle nozzle of the dishwasher according to an embodiment of the present invention.

The middle nozzle 25 according to the embodiment of the present invention includes an upper spray nozzle 25*a* spraying the washing water upward toward the upper rack 410, a lower spray nozzle 25*c* spraying the washing water downward toward the lower rack 420, and a middle spray nozzle 25*b* spraying the washing water upward and downward toward the middle rack 430. The spray angle of the middle spray nozzle 25*b* is preferably greater than that of each of the upper and lower spray nozzles 25*a* and 25*c*.

In a case where the middle rack 430 is attached to the washing tub 20, the upper, lower and middle spray nozzles 25*a*, 25*c* and 25*b* simultaneously or alternately spray the washing water. The process is preferably repeated, in which the upper and lower spray nozzles 25*a* and 25*c* spray the washing water, the middle spray nozzle 25*b* then sprays the washing water, and the upper and lower spray nozzles 25*a* and 25*c* spray the washing water again. In a case where the middle rack 430 is removed from the washing tub 20, the upper and lower spray nozzles 25*a* and 25*c* simultaneously or alternately spray the washing water.

Figure 6:
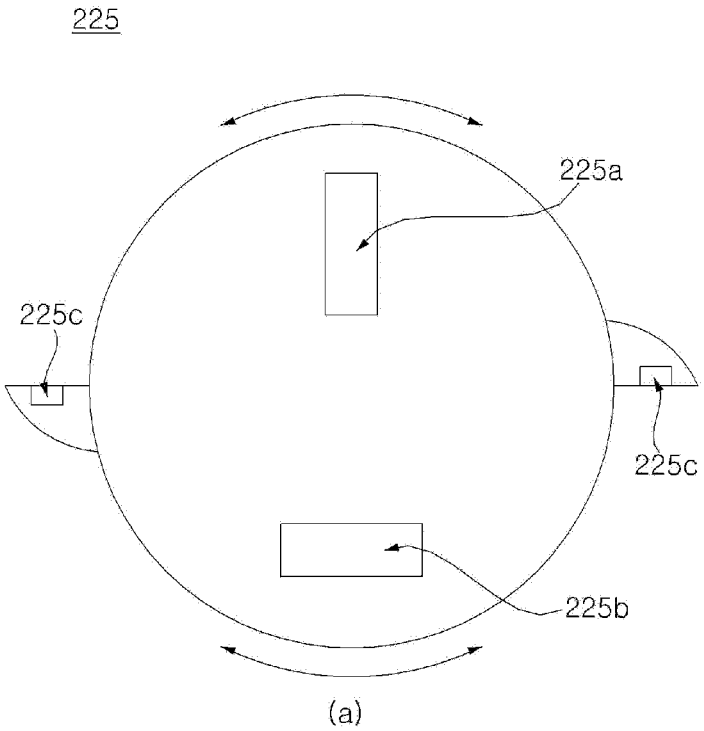
FIG. 6 is a view illustrating a middle nozzle of the dishwasher according to another embodiment of the present invention.
Figure 6:
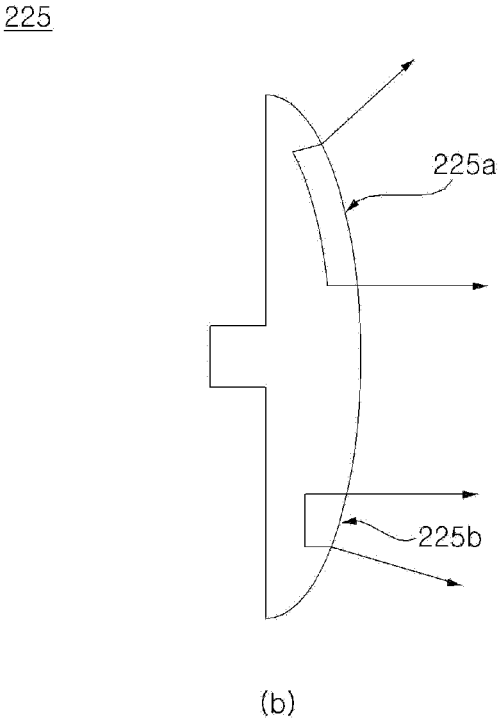

FIG. 6 is a view illustrating a middle nozzle of the dishwasher according to another embodiment of the present invention.

The middle nozzle 225 according to the embodiment of the present invention sprays the washing water while rotating. The middle nozzle 225 is formed in a circular shape. The middle nozzle 225 is rotatably provided on the rear and side walls 20(1) and 20(2). The middle nozzle 225 may be rotated by a motor, etc. or may be rotated by water pressure of the washing water. In the embodiment of the present invention, rotating spray nozzles 225*c* spraying the washing water in tangent directions are formed around the circumference of the middle nozzle 225. If the rotating spray nozzles 225*c* spray the washing water, the middle nozzle 225 is rotated by the water pressure of the washing water.

The middle nozzle 225 is provided with a wide angle spray nozzle 225*a* having a wide spray angle and a narrow angle spray nozzle 225*b* having a narrow spray angle. The wide angle spray nozzle 225*a* sprays the washing water with a wide angle, and the narrow angle spray nozzle 225*b* sprays the washing water with a narrow angle. When the middle nozzle 225 rotates, the washing water is sprayed with different angles through the wide and narrow angle spray nozzles 225*a* and 225*b*. Thus, the washing water is sprayed equally toward the dishes loaded to the upper, middle and lower racks 410, 430 and 420.

Although the preferred embodiments of the present invention have been disclosed for illustrative purposes, those skilled in the art will appreciate that various modifications, additions and substitutions are possible, without departing from the scope and spirit of the invention as disclosed in the accompanying claims. Such modified embodiments should not be understood as being separate from the technical spirit or scope of the present invention, but should be interpreted as being included in the accompanying claims of the present invention.

According to the dishwasher of the present invention, one or more effects can be obtained as follows.

First, the middle nozzle provided between the upper and lower racks is provided on the side walls of the washing tub, so that a dish with large size can be loaded to the lower rack.

Second, the middle nozzle provided on the side walls of the washing tub sprays washing water in various directions, so that the washing performance of the dishwasher is not deteriorated.

Third, the middle rack is provided between the upper and lower racks, so that the space of the dishwasher can be efficiently used.

The effects of the present invention are not limited to the above-described effects and other effects which are not described herein will become apparent to those skilled in the art from the accompanying claims.

What is claimed is:

1. A dishwasher, comprising:

a washing tub forming a space in which dishes are washed;

an upper rack to which the dishes are loaded, being provided inside the washing tub;

a lower rack provided below the upper rack, being provided inside the washing tub; and at least one middle nozzle configured to spray washing water toward the upper and lower racks, being provided on at least one side wall of the washing tub, wherein the middle nozzle is configured to spray the washing water while rotating, wherein the middle nozzle has a circular shape, and is configured to spray the washing water in tangent directions around a circumference of the circular shape of the middle nozzle, wherein the middle nozzle is rotated by water pressure of the washing water, and wherein the middle nozzle is directly attached to at least one side wall of the washing tub.

2. The dishwasher of claim 1, wherein the middle nozzle comprises:

rotating spray nozzles that are configured to spray the washing water in tangent directions and that are located around the circumference of the middle nozzle, and the middle nozzle is rotated by the water pressure of the washing water sprayed by the rotating spray nozzles.

3. The dishwasher of claim 2, wherein the middle nozzle is disposed between the upper and lower racks.

4. The dishwasher of claim 3, wherein the washing tub has a front opened, and the middle nozzle is provided with a plurality of middle nozzles provided on both side walls that are both sides of the opened front of the washing tub.

5. The dishwasher of claim 4, wherein the washing tub has a front opened, and the middle nozzle is provided on a rear wall that is opposite to the opened front of the washing tub.

6. The dishwasher of claim 5, further comprising a middle rack provided between the upper and lower racks.

7. The dishwasher of claim 6, wherein the middle rack is attachable/detachable to/from the washing tub.

8. The dishwasher of claim 1, wherein the middle nozzle is vertically overlapped with an edge of the upper rack and the lower rack.

9. The dishwasher of claim 1, wherein the middle nozzle is provided with a wide angle spray nozzle spraying the washing water and a narrow angle spray nozzle spraying the washing water, the washing water is sprayed with different angles through the wide and narrow angle spray nozzles with the wide angle spray nozzle having a wider spray angle than the narrow angle spray nozzle.

10. The dishwasher of claim 9, wherein the middle nozzle has an axis of rotation perpendicular to the side walls of the washing tub.

* * * * *